US007585605B2

(12) United States Patent
Nakamura

(10) Patent No.: US 7,585,605 B2
(45) Date of Patent: Sep. 8, 2009

(54) ELECTROSTATIC LATENT IMAGE DEVELOPER

(75) Inventor: Yasushige Nakamura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 391 days.

(21) Appl. No.: 11/406,274

(22) Filed: Apr. 19, 2006

(65) Prior Publication Data

US 2007/0048651 A1 Mar. 1, 2007

(30) Foreign Application Priority Data

Aug. 23, 2005 (JP) ..... 2005-240933

(51) Int. Cl.
*G03G 9/08* (2006.01)
*G03G 9/113* (2006.01)

(52) U.S. Cl. ..... 430/108.4; 430/111.33; 430/111.35

(58) Field of Classification Search ..... 430/111.33, 430/111.35, 108.4
See application file for complete search history.

(56) References Cited

U.S. PATENT DOCUMENTS

| | | | | |
|---|---|---|---|---|
| 5,204,204 | A * | 4/1993 | Shintani et al. | 430/111.35 |
| 6,183,927 | B1 | 2/2001 | Magome et al. | |
| 6,387,582 | B2 * | 5/2002 | Kayamoto et al. | 430/111.35 |
| 6,405,007 | B1 * | 6/2002 | Aita et al. | 430/111.35 |
| 6,455,218 | B2 * | 9/2002 | Isonaka et al. | 430/111.35 |
| 7,056,636 | B2 * | 6/2006 | Tomita et al. | 430/108.4 |
| 7,306,887 | B2 * | 12/2007 | Tanaka et al. | 430/108.4 |
| 2002/0006570 | A1 * | 1/2002 | Kayamoto et al. | 430/111.35 |
| 2002/0015905 | A1 * | 2/2002 | Isonaka et al. | 430/111.35 |
| 2002/0136974 | A1 * | 9/2002 | Nakamura et al. | 430/108.4 |
| 2003/0082471 | A1 * | 5/2003 | Imafuku et al. | 430/111.35 |
| 2006/0269863 | A1 * | 11/2006 | Nakamura et al. | 430/111.35 |

FOREIGN PATENT DOCUMENTS

JP A-08-179570 7/1996

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Diamond, Arthur S & David Weiss (eds.) Handbook of Imaging Materials, 2nd ed.. New York: Marcel-Dekker, Inc. (Nov. 2001) pp. 178-182.*

* cited by examiner

*Primary Examiner*—Christopher RoDee
(74) *Attorney, Agent, or Firm*—Oliff & Berridge, PLC

(57) ABSTRACT

The invention discloses an electrostatic latent image developer including a toner and a carrier. The carrier has cores and a coating resin including an electrically conductive material on the surface of each of the cores. The coating resin has an inner portion and an outermost portion, and the outermost portion is made of a cross-linked resin. The content of the electrically conductive material in the outermost portion is lower than that in the inner portion. The toner has toner mother particles, and, on the surface of each of the toner mother particles, inorganic particles and resin particles, and the resin particles are made of a non-cross-linking resin.

28 Claims, 1 Drawing Sheet

ELECTROSTATIC LATENT IMAGE DEVELOPER

CROSS-REFERENCE TO RELATED APPLICATION

This application claims priority under 35 USC 119 from Japanese Patent Application No. 2005-240933, the disclosure of which is incorporated by reference herein.

BACKGROUND OF THE INVENTION

1. Field of the Invention

The invention relates to an electrostatic latent image developer used for developing latent images formed by electrophotography, and an image-forming apparatus using the same.

2. Description of the Related Art

Methods for visualizing image information by forming latent images by electrophotography are presently used in various fields. In electrophotography, an electrostatic latent image is formed on the surface of a photoreceptor through electrically charging and exposure steps, and is developed (made visual) with an electrostatic latent image developer (hereinafter, simply referred to as "developer" in some cases) containing a toner to form a toner image, and the toner image is fixed on a recording medium through transfer and fixing steps.

Replacement of offset printers with electrophotographic printers which enable ultra-high speed, on-demand printing at a linear velocity exceeding 1,000 mm/second has been being considered in recent years to print newspaper and direct mail. In an effort to develop such electrophotographic printers, attempts are being made to improve the substantial printing volume by increasing the printing speed as well as adapting the electrophotographic printers to wide recording media. However, stress applied to a developer is proportional to the square of printing speed. Therefore, when printing speed is increased to a linear velocity as high as 1,000 mm/second or more, which corresponds to outputting about 400 A4-size sheets of paper or more for one minute, the developer suffers a stress far above the stress applied to the developer used in a desktop low speed printer.

An electrically conductive material, such as carbon black, used for adjusting electric resistance is usually contained in a coating resin on the surface of each carrier core in order to optimize printing performance. In the case of a color printer with a linear velocity as high as 1,000 mm/second or more, the electrically conductive material separates from the carrier alone or together with the coating resin due to a stress on the developer, and the free electrically conductive material stains color toners.

As for maintenance of printers, the interval for exchanging a developer in a high-speed printer is required to be almost the same as that in a low-speed printer. Therefore, the life of the developer used in a high-speed printer needs to be as long as that in a low-speed printer. Accordingly, it is necessary to prevent the electrically conductive material such as carbon black from separating from the coating resin of the carrier in a high-speed color printer and to provide the high-speed color printer with durability equal to or more than that of monochromatic printers.

In a proposed method for preventing carbon black from separating from the carrier to be mixed with a color toner, a magnetic core (core) of the carrier is coated with a coating agent containing carbon black, and then the coated magnetic core is further coated with the same coating agent containing no carbon black (see, for example Japanese Patent Application Laid-Open (JP-A) No. 8-179570). However, the surface coating layer abrades during a continuous operation of the high-speed printer, and staining of color toners by carbon black becomes evident as a result of the continuous operation, though no separation of carbon black is observed at the start of the operation.

On the other hand, as for fixing systems, the most crucial issue in the high-speed printer is to prevent paper from jamming and paper powder from occurring by friction between the printer and paper sheet. A non-contact fixing method that allows less contact with recording media and seldom causes paper jamming is desirable, and an open fixing method and a flash fixing method are usually effective for this purpose. A printer conducting an optical fixing method (referred to as a flash fixing method in some cases) is particularly attracting attention, since the printer provides high image quality and compatibility with a wide range of media, is able to start quickly without any standby power requirement, and has high reliability against paper jamming.

Therefore, stability of the developer is particularly important when employing the optical fixing method. Moreover, it is a crucial issue to stabilize characteristics of the developer in the ultra-high speed, on-demand printer.

Accordingly, there is a need for an electrostatic latent image developer having a bright color with a long life in developing an ultra-high speed electrophotographic printer. There is also a need for an image-forming apparatus using the electrostatic latent image developer.

SUMMARY OF THE INVENTION

The invention has been made in view of the above circumstances.

A first aspect of the invention provides an electrostatic latent image developer including a toner and a carrier, wherein the carrier has cores and a coating resin containing an electrically conductive material on the surface of each of the cores, and the coating resin has an inner portion and an outermost portion, and the outermost portion is made of a cross-linked resin, and the content of the electrically conductive material in the outermost portion is lower than that in the inner portion, and the toner has toner mother particles, and, on the surface of each of the toner mother particles, inorganic particles and resin particles, and the resin particles are made of a non-cross-linking resin A second aspect of the invention provides an image forming apparatus having: a unit for forming, on a recording medium, a full color toner image from developers including a carrier and respectively including a cyan toner, a magenta toner and a yellow toner; and a unit for fixing the toner image on the recording medium by at least one of heating and pressurizing, or by light, wherein the cyan toner, the magenta toner and the yellow toner contain an infrared absorbent, and the carrier has cores and a coating resin containing an electrically conductive material on the surface of each of the cores, and the coating resin has an inner portion and an outermost portion, and the outermost portion is made of a cross-linked resin, and the content of the electrically conductive material in the outermost portion is lower than that in the inner portion, and the toner has toner mother particles, and, on the surface of each of the toner mother particles, inorganic particles and resin particles, and the resin particles are made of a non-cross-linking resin A third aspect of the invention provides an image forming apparatus having: a unit for forming, on a recording medium, a toner image from a developer containing a carrier and a toner for cipher printing; and a unit for fixing the toner image on the recording medium by at least one of heating and pressurizing, or by light, wherein the toner for cipher printing includes an infrared absorbent, and the carrier has cores and a coating resin including an electrically conductive material on the surface of each of the cores, and the coating resin has an inner portion and an outermost portion, and the outermost portion is made of a cross-linked resin, and the content of the electrically conductive material in the outermost portion is lower than that in the inner portion, and the toner has toner mother particles, and, on the surface of each of the toner mother particles, inorganic particles and resin particles, and the resin particles are made of a non-cross-linking resin.

The invention provides an electrostatic latent image developer capable of preventing an electrically conductive material contained in the coating resin of a carrier from separating from the carrier core and having a bright color and a long life, and an image-forming apparatus using the developer.

BRIEF DESCRIPTION OF THE DRAWINGS

Preferred embodiments of the invention will be described in detail based on the following figure, wherein FIG. 1 schematically illustrates an example of the structure of the image-forming apparatus of the invention.

DETAILED DESCRIPTION OF THE INVENTION

Figure 1:
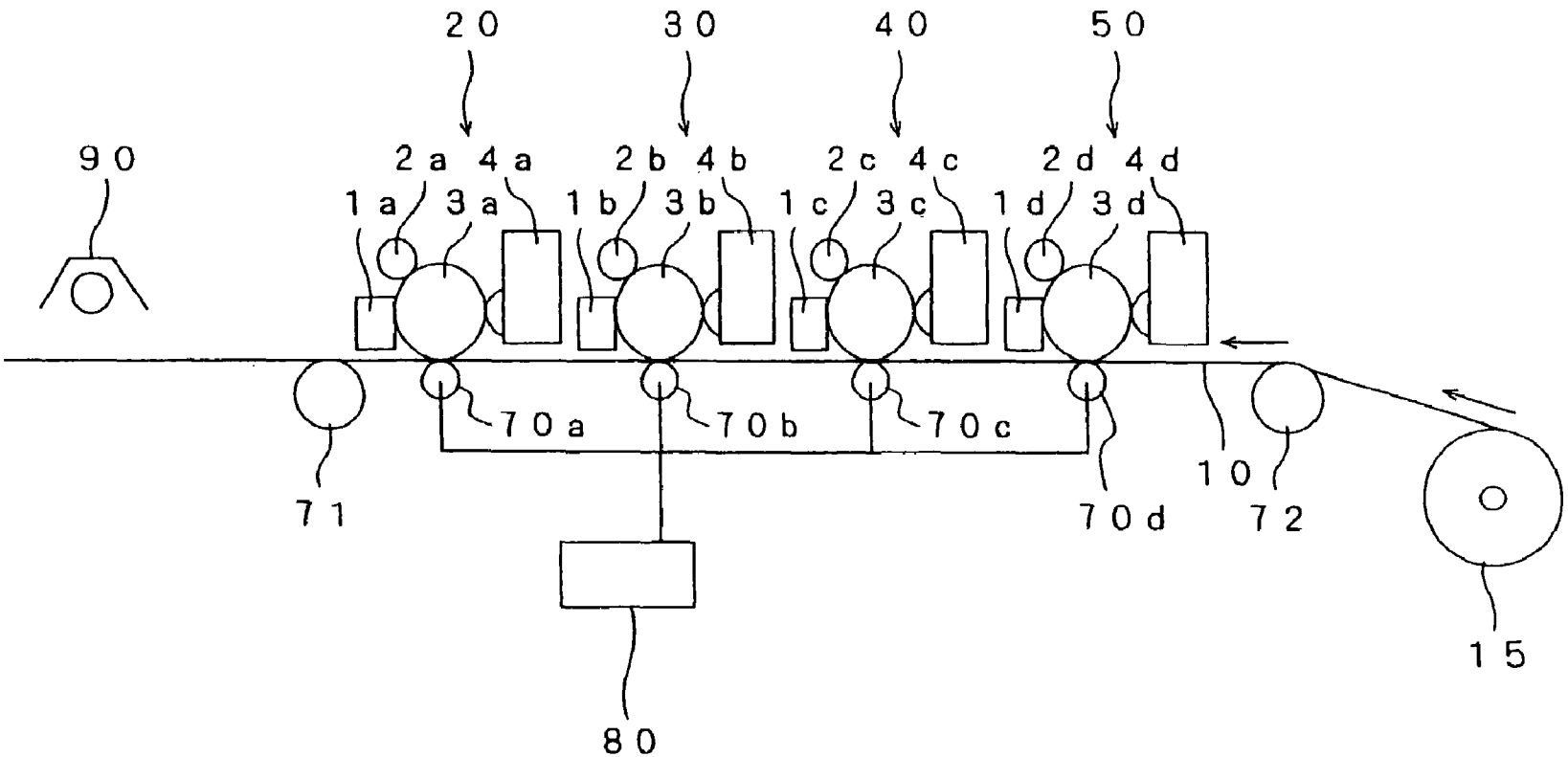

The invention will be described in detail below.

<Electrostatic Latent Image Developer>

The invention provides an electrostatic latent image developer including a toner (toner particles) and a carrier (carrier particles). Each carrier particle has a core, and a resin coating layer containing an electrically conductive material on the surface of the core. The resin coating layer has an inner portion and an outermost portion. The outermost portion is made of a cross-linked resin. Moreover, the content of the electrically conductive material in the outermost portion is lower than that in the inner portion. Each toner particle has a toner mother particle, and, on the surface of the toner mother particle, inorganic particles and resin particles. The resin particles are made of a non-cross-linking resin.

As described above, when an electrically conductive material such as carbon black is contained in the coating resin on the surface of the carrier core, the electrically conductive material separates from the carrier core during continuous operation. Since the developer receives large stress in a high-speed color printer operated at a linear velocity of 1000 mm/second or more, the separation of the electrically conductive material from the carrier core often occurs, and the free electrically conductive material stains the color toner.

The separation of the electrically conductive material herein includes abrasion of the coating resin rather than simply referring to the separation of the electrically conductive material from the coating resin.

As for the above problem, the inventors found, as disclosed in JP-A No. 2002-23429, that abrasion resistance of the coating resin is improved by forming, on the surface of the carrier core, the coating layer which is made of a cross-linked silicone resin and in which the content of chloroform-soluble components is within a predetermined range. However, even use of the carrier having such a resin coating layer cannot provide a sufficient effect of preventing the electrically conductive material from separating from the carrier core.

The inventors of the invention have made an intensive study to locate the cause of the separation, and have found that abrasion of the carrier coating resin in a high-speed image-forming process conducted at a linear velocity of 1,000 mm/second or more is mainly caused by the following fact. That is, hard inorganic particles, such as silica, added to the surfaces of the toner mother particles operate as stress against the surface of the coating resin, which does not occur in a low-speed image-forming process. The inorganic particles undesirably serve as an abrasive and damage or abrade the surface of the coating resin. It cannot be usually anticipated that silica particles having a diameter of several tens millimeters act as a strong abrasive.

The inventors have found that a highly durable developer (carrier) compatible with a high-speed image-forming process and reducing the abrasion of the coating resin caused by the inorganic particles can be obtained by using a cross-linked resin as the coating resin and adding resin particles as well as inorganic particles to the surfaces of the toner mother particles and have devised the invention.

Specifically, it is essential in the invention that the outermost portion of the coating resin provided on the surface of the carrier core is made of a cross-linked resin, and that resin particles made of a non-cross-linking resin as well as inorganic particles are used as external additives of the toner. When the coating resin is a non-cross-linking resin, the coating resin has low abrasion resistance and readily abrades due to the inorganic particles such as silica. With the abrasion of the coating resin, the electrically conductive material such as carbon separates from the carrier core and the free electrically conductive material stains a developer containing a color toner (or toner for cipher printing). When the resin of the resin particles is cross-linked, the resin particles have hardness similar to that of the coating resin and accelerate abrasion of the coating resin.

In the invention, the coating resin of the carrier has an outermost portion made of a cross-linked resin to enhance abrasion resistance of the carrier. Moreover, the resin particles added to the surfaces of the toner mother particles act as spacers to prevent the inorganic particles from accelerating abrasion of the coating resin and to protect the coating resin from the inorganic particles.

The coating resin of the carrier does not easily abrade and stain of the toner (developer) caused by abrasion of the coating resin does not occur by using the cross-linked resin in the outermost portion of the carrier coating resin, and by using the non-cross-linking resin as the material of the resin particles contained in the toner and used to protect the coating resin.

The carrier and toner of the electrostatic latent image developer of the invention will be described hereinafter.

Carrier

The material of the core of the carrier in the invention can be ferrite, magnetite and/or iron powder, and, from the viewpoint of long life, is preferably ferrite containing manganese, strontium and/or magnesium. This is because such ferrite has high magnetic force and an almost perfect spherical shape. The ferrite is available from Powder Tech Co., Kanto Denka Kogyo Co. Ltd. and Dowa Iron Powder Co. Ltd.

The ferrite is more preferably manganese ferrite represented by the following formula (1).

$$(MnO)_x(Fe_2O_3)_y \qquad \text{Formula(1)}$$

In the formula, x and y represent molar ratios. These satisfy the relation of $x+y=100$, with x in the range of 10 to 45. When the molar ratio x of MnO is less than 10 mol %, the resultant ferrite tends to have bad stability, and stress may change the resistance of the ferrite and may, therefore, deteriorate the developing property of a developer including such ferrite. On the other hand, when the molar ratio of MnO exceeds 45 mol %, the ferrite particles tends to have irregular shapes, and stress in a development unit readily causes the toner to firmly adhere to the surface of the carrier, and such filming changes the resistance of the carrier.

The core preferably contains silicon as well as manganese metal. The silicon can be contained in the form of silicon dioxide ($SiO_2$). The content of the silicon dioxide may be 0.1 to 0.5 parts by mass in 100 parts by mass of the core. The shape of the carrier is influenced by the content of silicon. The higher the content of silicon is, the narrower the grooves at grain boundaries are. The narrower the grooves are, the smoother the surface of the core is. The core having a smooth surface has improved fluidity and a longer life and enables stable printing of sharp line images. The content of silicon dioxide ($SiO_2$) can be obtained through X-ray photoelectron spectroscopic analysis.

When the content of silicon dioxide is less than 0.1 parts by mass, the grooves are wide, and the coating resin covers in the grooves, which may result in formation of an un-uniform film. When the content of silicon dioxide exceeds 0.5 parts by mass, the core has a too smooth surface, and the coating layer is difficult to retain on the core, and readily separates from the core, which markedly deteriorates the charging property of the carrier, in some cases.

The saturation magnetization value of the core is preferably in the range of about 45 to about 95 $Am^2/kg$.

The core used in the invention is preferably a ferrite core having a volume average particle diameter in the range of, for example, about 20 to about 90 μm, and preferably in the range of about 30 to about 50 μm. When the volume average particle diameter is less than about 20 μm, adhesion of the resultant carrier to a photoreceptor (carrier adhesion) may readily occur. When the volume average particle diameter exceeds about 90 μm, image quality tends to deteriorate.

As for the resin(s) for coating the surface of the core, it is necessary that the resin of the outermost portion be cross-linked. A cross-linkable resin is used to form such an outermost portion. Examples of the cross-linkable resin include cross-linkable fluorinated resins, cross-linkable epoxy resins and cross-linkable silicone resins.

The cross-linkable resin is preferably a cross-linkable epoxy resin and/or a cross-linkable silicone resin, and the cross-linkable silicone resin is preferably a cross-linkable straight silicone resin and/or a fluorine-modified silicone resin.

In the invention, it is sufficient that the outermost portion of the coating resin be made of a cross-linked resin. When the inner and outermost portions form different layers, the inner portion may be made of either a cross-linked resin or a non-cross-linking resin. The inner portion may also be made of a cross-linked resin the same as that of the outermost portion.

Examples of the non-cross-linking resin include non-cross-linking fluorinated resins, acrylic resins, non-cross-linking epoxy resins, polyester resins, fluorinated acrylic resins, acrylic component-styrene resins and straight silicone resins, or silicone resins each modified with an acrylic resin, a non-cross-linking epoxy resin, a polyester resin, a fluorinated acrylic resin, an acrylic component-styrene resin, an alkyd resin and/or an urethane resin. The non-cross-linking resin is preferably a straight silicone resin and/or a fluorine-modified silicone resin, and more preferably a fluorine-modified silicone resin.

Examples of the straight silicone resins serving as the cross-linkable resin and the non-cross-linking resin include those having a repeating unit represented by the following formula (II) or (III).

(II)

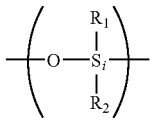

(III)

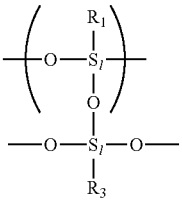

In formulae (II) and (III), $R_1$, $R_2$ and $R_3$ independently represent a hydrogen atom, a halogen atom, a hydroxyl group, or an organic group such as a methoxy group, an alkyl group having one to four carbon atoms, or a phenyl group.

The fluorine-modified silicone resin is, for example, a cross-linkable fluorine-modified silicone resin obtained by hydrolyzing a compound having a repeating unit represented by formula (II) or (III) and an organic silicon compound containing at least one perfluoroalkyl group. Examples of the organic silicon compound containing at least one perfluoroalkyl group include $CF_3CH_2CH_2Si(OCH_3)_3$, $C_4F_9CH_2CH_2Si(CH_3)(OCH_3)_2$, $C_8F_{17}CH_2CH_2SI(OCH_3)_3$, $C_8F_{17}CH_2CH_2Si(OC_2H_5)_3$ and $(CF_3)_2CF(CF_2)_8CH_2CH_2Si(OCH_3)_3$.

Specific examples of the electrically conductive material in the invention include metals such as gold, silver and copper; carbon black; electrically conductive metal oxides such as titanium oxide and zinc oxide; and composites prepared by coating the surfaces of particles of titanium oxide, zinc oxide, aluminum borate, potassium titanate, tin oxide and indium tin oxide with an electrically conductive metal oxide.

The electrically conductive material is preferably carbon black from the viewpoints of production stability, low cost and low electric resistance. The kind of carbon black is not particularly restricted, but carbon black preferably has a DBP (dibutyl phthalate) (oil) absorption amount of about 50 to about 300 ml/100 g from the viewpoint of production stability. The average particle diameter of the electrically conductive material powder is preferably 0.1 μm or less. The electrically conductive material powder preferably has a primary particle diameter of 50 nm or less, considering dispersibility thereof in the resin. The electrically conductive material preferably has a specific surface area of 700 $m^2/g$ or more, since such a material has high electric conductivity and, even when the amount thereof in the coating resin is small, can sufficiently reduce the carrier resistance. Ketchen Black (manufactured by Lion Co.) is preferable as carbon black satisfying those conditions.

In order to diminish the effect of separation of the electrically conductive material at the time that a developer including the electrically conductive material is being used, it is necessary that the content of the electrically conductive material in the outermost portion of the coating resin be lower than that in the inner portion of the coating resin. To meet this requirement, the coating resin preferably has a layered structure having an inner layer serving as the inner portion and an outermost layer serving as the outermost portion. Alternatively, the inner and outermost portions may form a single layer and the content of the electrically conductive material in the single layer may gradually or stepwise decrease toward the surface of the single layer.

The content of the electrically conductive material in a portion of the coating resin having the above-described structure, which portion has a thickness of 0.5 μm from the carrier surface, is preferably in the range of about 0 to about 3% by mass, and more preferably in the range of about 0.1 to about 1% by mass. In the coating resin having a content of the electrically conductive material of more than about 3% by mass, even when the rate of the electrically conductive material separating from the outermost layer is low, stain of the toner caused by the free electrically conductive material may be remarkable.

The content of the electrically conductive material in the remaining portion, which has a depth of more than 0.5 μm from the carrier surface, is preferably in the range of about 10 to about 20% by mass, and more preferably in the range of about 13 to about 17% by mass. When the content is less than about 10% by mass, such a carrier has high electric resistance and an image with a high density cannot be obtained in some cases. When the content exceeds about 20% by mass, such a carrier has low electric resistance and may, therefore, often cause fogging due to charge injection.

The carrier in the invention can be obtained by coating the core with a resin containing the electrically conductive material in accordance with a known method such as a spray drying method using a fluidized bed, a rotary drying method, or a dip coating method using a universal stirrer. The spray dry method using a fluidized bed is recommended among these methods to increase the coating rate of the carrier surface.

The coating resin layer is preferably composed of inner and outermost layers in the invention, as described above. Such a coating resin layer is preferably produced by coating a core with a solution containing a cross-linkable or non-cross-linking resin and an electrically conductive material in accordance with a spray method using a fluidized bed to form an inner layer, and dipping the resultant in another solution containing a cross-linkable resin and an electrically conductive material to form an outermost layer. Empirically, a uniform coating is obtained in a spray method, while an uneven coating is often obtained in a dip coating method. Accordingly, when each of the inner and outermost layers is formed by a spray method, these layers are both uniform films. However, an electrically conductive material such as carbon black easily separates from such films.

In the immersion method, the carrier core surface is coated by dissolving a coating resin in a solvent, dispersing core particles in the resultant solution, and removing the solvent from the resulting coating on each of the core particles, which are being stirred, at a reduced pressure and/or under heat.

For the aforementioned reason, in order to exhibit the effect of the invention, a spray method, which can provide a uniform coating, is preferably used to form an inner layer, whereas an immersion method is preferably used to form an outermost layer. Specifically, carrier cores having thereon a coating which contains an electrically conductive material such as carbon black and is obtained by spray coating under stirring stress are put into the coating solution to form an outermost layer, and the resultant overcoat is cross-linked. Thereby, a resin coating layer which is uniform to a certain extent can be obtained and, further, the electrically conductive material can be suppressed from separating from the carrier cores in a printer. The reason for this is that the cross-linked hard outermost layer covers the inner layer including more electrically conductive material.

The solvent used in the solution for forming a coating resin layer needs to dissolve a coating resin (matrix resin) and otherwise it is not particularly limited. Examples of the solvent include aromatic hydrocarbon solvents such as toluene and xylene, ketones such as acetone and methyl ethyl ketone, and ethers such as tetrahydrofuran and dioxane. A sand mill, a dyno mill and/or a homomixer may be used for dispersing the resin particles and the electrically conductive power.

The solution for forming a coating resin layer may contain a charge control agent and a resistance control agent, if necessary. When a silicone resin is used as a coating resin, the solution preferably contains a metal catalyst to help cure the resin. An organic compound including aluminum, calcium, barium, manganese, tin, cobalt and/or zinc is known as the metal catalyst.

Either an external heating method or an internal heating method may be used for baking the resin coated on the cores. For example, the resin may be baked with a stationary-type or fluid-type electric furnace, a rotary electric furnace, a burner furnace or microwave. The baking temperature depends on the type of the resin used, but needs to be equal to or more than the melting point or glass transition point of the resin. Moreover, when a thermosetting resin or a condensation cross-linkable resin is used, it is necessary to raise the temperature of the resin so as to sufficiently advance curing of the resin. In the case of, for example, a silicone resin, the resin is preferably kept at a temperature of about 200 to about 300° C. for about 30 minutes.

After the resin coated on the surface of each of the core particles is baked, the resultant is cooled and disintegrated, and the particles obtained are classified to gain carrier particles having a controlled average diameter and a cross-linked coating resin layer. The particles obtained by the disintegrating may be subjected to a post treatment so as to remove roughness and/or flash on the surfaces thereof and to sufficiently disintegrate agglomerate particles arising through the coating. Any of post treatment methods or apparatuses known in the art may be used so long as mechanical stress can be applied to the particles. For example, the post treatment apparatus can be a Nauter mixer, a ball mill and/or a vibro mill, but is not restricted thereto.

A method for fixing resin particles on the surfaces of carrier cores in a dry manner is known as one of conventional coating methods. However, good carrier particles which can prevent an electrically conductive material such as carbon black from separating from the core particles cannot be obtained by this method, since the carrier cores cannot be coated sufficiently and uniformly.

The amount of the coating resin of the inner layer is preferably in the range of about 0.5 to about 3 parts by mass relative to 100 parts by mass of the carrier. In this case, the thickness of the coating resin is empirically within the range of about 0.5 to about 3 μm. When the amount is less than about 0.5 parts by mass, the resultant coating resin layer is so thin that the cores are partially bare, which makes it impossible to control the electric resistance of the carrier and easily causes fogging and/or carrier adhesion. When the amount exceeds about 3 parts by mass, the carrier particles excessively coagulate.

The amount of the coating resin of the outermost layer is preferably in the range of about 0.1 to about 1 part by mass relative to 100 parts by mass of the carrier. In this case, the thickness of the coating resin is empirically within the range of about 0.1 to about 1 μm. When the amount is less than about 0.1 parts by mass, the outermost layer readily abrades and, therefore, does not have the effect of preventing an electrically conductive material such as carbon black from separating from carrier cores. When the amount exceeds about 1 part by mass, the resultant carrier has an increased electric resistance and, therefore, cannot provide images having a desired density.

The electric resistance of the carrier in the invention is preferably controlled within the range of about $1\times10^3$ to about $1\times10^{12}$ Ωcm, and more preferably within the range of about $1\times10^4$ to about $1\times10^8$ Ωcm.

When the electric resistance of the carrier is high and exceeds about $1\times10^{12}$ Ωcm, such a carrier cannot sufficiently serve as a development electrode during development, and this deteriorates reproducibility of solid images, and, for example, edge effect appears in images, particularly in solid image portions. When the electric resistance of the carrier is low and is less than about $1\times10^3$ Ω·cm, electric charge undesirably migrates from a development roll to the carrier at the time that the concentration of the toner in a developer becomes low, and the carrier undesirably adheres to a latent image.

Toner

The toner of the invention may contain at least one binder resin and at least one coloring agent known in the art. The principal component of the binder resin is most preferably at least one of polyester resins and polyolefin resins. However, the component can also be at least one of styrene-(meth) acrylic acid copolymer, polyvinyl chloride, phenol resin, acrylic resin, methacrylic resin, polyvinyl acetate, silicone resin, modified polyester resin, polyurethane, polyamide resin, furan resin, epoxy resin, xylene resin, polyvinyl butyral, terpene resin, cumarone-indene resin, petroleum-based resin and polyether polyol resin. The principal component is preferably at least one of polyester resin and norbornene polyolefin resin from the viewpoints of durability and light transmittance.

The glass transition point (Tg) of the binder resin is preferably in the range of about 50 to about 70° C.

The electrostatic latent image developer of the invention is preferably used as developers for full-color image formation, since the electrically conductive material does not easily separate from the surface of the carrier of the inventive developer, as aforementioned. The toner of the developer is preferably any of cyan, magenta and yellow toners.

The coloring agents to be used in these toners may be appropriately selected according to the color of the corresponding toner.

Examples of the coloring agent used in the cyan toner include cyan pigments, such as C.I. pigment blue 1, 2, 3, 4, 5, 6, 7, 10, 11, 12, 13, 14, 15, 15:1, 15:2, 15:3, 15:4, 15:6, 16, 17, 23. 60, 65, 73, 83, and 180, C.I. bat cyan 1, 3, and 20, ultramarine blue, cobalt blue, alkali blue lake, phthalocyanine blue, metal-free phthalocyanine blue, partial chloride of phthalocyanine blue, fast sky blue, and indanthrene blue BC; and cyan dyes, such as C.I. solvent cyan 79 and 162. C.I. pigment blue 15:3 is effective as the cyan coloring agent among these pigments and dyes.

Examples of the coloring agent used in the magenta toner include magenta pigments, such as C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, and 209, and pigment violet 19; magenta dyes, such as C.I. solvent red 1, 3, 8, 23, 24, 25, 27, 30, 49, 81, 82, 83, 84, 100, 109, and 121, C.I. disperse red 9, C.I. basic red 1, 2, 9, 12, 13, 14, 15, 17, 18, 22, 23, 24, 27, 29, 32, 34, 35, 36, 37, 38, 39, and 40; and iron oxide red, cadmium red, red lead, mercury sulfide, cadmium, permanent red 4R, lithol red, pyrazolone red, watching red, calcium salts, lake red D, brilliant carmine 6B, eosin lake, rhodamine lake B, alizarin lake and brilliant carmine 3B.

Examples of the coloring agent used in the yellow toner include yellow pigments such as C.I. pigment yellow 2, 3, 15, 16, 17, 97, 180, 185, and 139.

Examples of the coloring agent used in the black toner include carbon black, active carbon, titanium black, magnetic powder and non-magnetic powder including manganese.

The amount of the coloring agent(s) is preferably in the range of about 1 to about 20 parts by mass relative to 100 parts by mass of a toner (toner particles) prepared by mixing a binder resin with the coloring agent(s).

The electrostatic latent image developer of the invention is also preferably used as a developer including a toner for cipher printing, for the reason the same as why the electrostatic latent image developer is preferably used as a developer for full-color image formation, which has been aforementioned. The toner for cipher printing, which toner has high transparency, preferably contains no coloring agent. Alternatively, when the toner for cipher printing includes an IR absorbent and a coloring agent whose color is complementary to the color of the IR absorbent so as to correct the color of the IR absorbent, the amount of the coloring agent is preferably not more than 2 parts by mass relative to 100 parts by mass of the toner particles.

The toner for cipher printing is used to print cipher which is deciphered irradiating the cipher with specific light, such as infrared. The toner may or may not be recognized with naked eyes, when fixed on a recording sheet as a toner image. In other words, the toner refers to the toner used to print cipher images, such as IR absorbing patterns, including bar codes. Even toners each including at least one coloring agent in such a content that the color of the at least one coloring agent cannot be evidently recognized, specifically in a content of 1% or less, can be included within the scope of the toner for cipher printing. Accordingly, the composition of the toner for cipher images is the same as the compositions of color toners, except that it does not substantially contain a coloring agent. The toner for cipher printing of the invention can be fixable with light.

When the toner of the invention is a color toner fixable with light described later, the color toner preferably contains an infrared (IR) absorbent. The IR absorbent refers to a material having at least one strong light absorption peak in the near infrared region whose wavelength ranges from 800 to 2000 nm, and can be either organic or inorganic.

The IR absorbent may be any known one. For example, the IR absorbent can be at least one of cyanine compounds, merocyanine compounds, benzenethiol metal complexes, mercaptophenol metal complexes, aromatic diamine metal complexes, diimmonium compounds, aminium compounds, nickel complex compounds, phthalocyanine compounds, anthraquinone compounds, naphthalocyanine compounds and lanthanide compounds.

Specific examples thereof include nickel metal complex IR absorbent (SIR-130 and SIR-132 manufactured by Mitsui Chemicals Inc.), bis(dithiobenzyl)nickel (MIR-101 manufactured by Midori Chemical Co., Ltd.), bis[1,2-bis(p-methoxyphenyl)-1,2-ethylenedithiolate]nickel (MIR-102 manufactured by Midori Chemical Co., Ltd.), tetra-n-butylammoniumbis(cis-1,2-diphenyl-1,2-ethylenedithiolate)nickel (MIR-1011 manufactured by Midori Chemical Co., Ltd.), tetra-n-butylammoniumubis[1,2-bis(p-methoxydiphenyl)-1,2-ethylenedithiolate]nickel (MIR-1021 manufactured by Midori Chemical Co., Ltd.), bis(4-tert-1,2-butyl-1,2-dithiophenolate)nickel-tetra-n-butylammonium (BBDT-NI manufactured by Sumitomo Seika Chemicals Co., Ltd.), cyanine IR absorbents (IRF-106 and IRF-107 manufactured by Fuji Photo Film Co., Ltd.), cyanine IR absorbent (YKR2900 manufactured by Yamamoto Chemicals, Inc.), aminium, diimmonium IR absorbents (NIR-AM1 and IM1 manufactured by Nagase Chemtex Corp.), immonium compounds (CIR-1080 and CIR-1081 manufactured by Japan Carlit Co., Ltd.), aminium compounds (CIR-960 and CIR-961 manufactured by Japan Carlit Co., Ltd.), an anthraquinone compound (IR-750 manufactured by Nippon Kayaku Co., Ltd.), aminium compounds (IRG-002, IRG-003, and IRG-003K manufactured by Nippon Kayaku Co., Ltd.), a polymethine compound (IR-820B manufactured by Nippon Kayaku Co., Ltd.), diimmonium compounds (IRG-022 and IRG-023 manufactured by Nippon Kayaku Co., Ltd.), dianine compounds (CY-2, CY-4 and CY-9 manufactured by Nippon Kayaku Co., Ltd.), soluble phthalocyanine (TX-305A manufactured by Nippon Shokubai Co., Ltd.), Naphthalocyanine (YKR5010 manufactured by Yamamoto Chemical Inc. and SAMPLE 1 manufactured by Sanyo Color Works, Ltd.), and inorganic compounds (ytterbium UU-HP manufactured by Shin-Etsu Chemical Co., Ltd.; indium-tin oxide manufactured by Sumitomo Metal Industries, Ltd.; and lanthanum fluoride manufactured by Sumitomo Metal Mining Co., Ltd.).

The IR absorbent is preferably at least one of naphthalocyanine, aminium and diimmonium IR absorbents among those compounds form the viewpoints of environmental safety and color tone. A thiol nickel complex, which has preferable color tone, has high toxicity such as carcinogenicity, and, therefore, is the most unsuitable coloring agent to be included in toners. Moreover, many cyanine coloring agents may cause hematopoietic disorder and/or cancer, when repeatedly administered to mice for 28 days. Therefore, a cyanine coloring agent may not be so suitable, either. When a nickel complex and/or a cyanine compound is used as the IR absorbent, it is preferable that the nickel complex and/or the cyanine compound does not have such risk factors.

The IR absorbent used in the toner for cipher printing is preferably at least one of ytterbium oxide, ytterbium phosphate, lanthanum fluoride, diimmonium, naphthalocyamine and aminium IR absorbents, which are almost white, from the viewpoints of environmental safety and color tone.

At least two of these IR absorbents may be used together. Combined use of at least two IR absorbents is more effective in expanding the wavelength range of infrared which a toner can absorb and improving fixability of the toner than use of a single IR absorbent. When the IR absorbent is organic, the amount thereof is preferably in the range of about 0.01 to about 5 parts by mass relative to 100 parts by mass of toner particles. When the IR absorbent is inorganic, the amount thereof is preferably in the range of about 5 to about 70 parts by mass relative to 100 parts by mass of toner particles. When the amount of the organic IR absorbent is less than about 0.01 parts by mass, the toner may be insufficiently fixable. When the amount exceeds about 5 parts by mass, the resultant printed matter may have turbid color and, therefore, may be unacceptable. Since the inorganic IR absorbent has relatively light color and, therefore insufficient light absorbing ability, inclusion of a large amount of the inorganic IR absorbent in a toner is acceptable. Inclusion of the inorganic IR absorbent in an amount larger than the amount of the organic IR absorbent is, rather, necessary. When the amount of the inorganic IR absorbent is less than about 5 parts by mass, the toner may be insufficiently fixable. When the amount exceeds about 50 parts by mass, fixability of the toner due to the binder resin is low and, therefore, the toner may be insufficiently fixable.

The toner of the invention may contain at least one charge control agent and/or at least one type of wax.

When the toner includes one or more charge control agents, at least one of the one or more charge control agents should be a known quaternary ammonium salt. In this case, the remaining can be at least one of calix arenes, nigrosine dyes, amino group-containing polymers, metal-containing azo dyes, salicylic acid complexes, phenol compounds, azochrome compounds and azo zinc compounds. The charge control agent can also be a magnetic material such as iron powder, magnetite or ferrite. The toner including such a magnetic material can be used as a magnetic toner. In the case of a color toner, the toner can contain a white magnetic powder known in the art.

Examples of the wax included in the toner of the invention include ester wax, polyethylene, polypropylene, polyethylene-polyethylene copolymer, polyglycerin wax, microcrystalline wax, paraffin wax, carnauba wax, Sasol wax, montanoic acid ester wax, deacidified carnauba wax, saturated or unsaturated fatty acids such as palmitic acid, stearic acid, montanic acid, brassidic acid, eleostearic acid and parinaric aci, saturated alcohols such as stearic alcohol, aralkyl alcohol, behenyl alcohol, carnaubyl alcohol, ceryl alcohol, melissyl alcohol, and long chain alcohols having at least one alkyl group longer than the described above, polyhydric alcohols such as sorbitol, fatty acid amides such as linoleic acid amide, oleic acid amide and lauric acid amide, saturated fatty acid bisamides such as methylenebisstearic acid amide, ethylenebiscapric acid amide, ethylenebislauric acid amide and hexamethylenebisstearic acid amide, unsaturated fatty acid amides such as ethylenebisoleic acid amide, hexamethylenebisoleic acid amide, N,N'-dioleyladipic acid amide and N,N'-dioleylsebacic acid amide, aromatic bisamides such as m-xylenebisstearic acid amide, and N,N'-distearylisophthalic acid amide, fatty acid metal salts such as calcium stearate, calcium laurate, zinc stearate and magnesium stearate (generally called metal soaps), wax prepared by graft-polymerizing aliphatic hydrocarbon wax with at least one vinyl monomer such as styrene and acrylic acid, partially esterified compounds of fatty acids and polyhydric alcohols such as behenic acid monoglyceride, and methyl ester compounds having at least one hydroxyl group and obtained by hydrogenizing vegetable oil. The wax is preferably ester wax to improve fixability of a toner and to reduce voids.

The wax used in the toner preferably has an endothermic peak, measured by differential scanning calorimetric (DSC) measurement, in the temperature range of about 50 to about 110° C. When the endothermic peak appears at a temperature below about 50° C., the toner particles undesirably agglomerate (blocking phenomenon). When the endothermic peak appears at a temperature above about 110° C., such a wax may not contribute to fixing. A highly precise, internal heat input compensation-type differential scanning calorimeter is preferably used in the DSC measurement, considering the measurement principle thereof.

The toner described above can be produced by a conventional kneading pulverization method or a wet granulation method. Examples of the wet granulation method include a suspension polymerization method, an emulsion polymerization method, an emulsion polymerization aggregation method, a soap-free emulsion polymerization method, a non-aqueous dispersion polymerization method, an in-situ polymerization method, an interfacial polymerization method and an emulsion dispersion granulation method.

When the toner is produced by the kneading pulverization method, at least one compatible binder resin, a wax, a charge control agent, a pigment or dye serving as a coloring agent, a magnetic material, an IR absorbent and other additives can be thoroughly mixed with each other in a mixer such as a HENSCHEL mixer or a ball mill, and the resultant mixture can be melted and kneaded with a heat kneader such as a heating roll, a kneader or an extruder to disperse or dissolve a metal compound, the pigment or dye, the magnetic material and other components in the molten matter of the at least one binder resin, and the resultant is cooled down and pulverized, and the resulting particles are classified. At least one of the pigment and the IR absorbent can be in the form of a master batch to improve dispersibility thereof.

When the color toner or the toner for cipher printing includes an IR absorbent, the toner can contain the IR absorbent dispersed in the binder resin, which is aforementioned, or can include the IR absorbent bonded to or fixed on the surfaces of the toner (mother) particles.

Examples of a surface modification apparatus for bonding or fixing an IR absorbent on the surfaces of toner particles include those which imparts impact on toner particles in a high-speed gas flow, such as SURFUSING SYSTEM manufactured by Nippon Pneumatic Mfg Co., Ltd., HYBRIDIZATION SYSTEM manufactured by Nara Machinery Co., Ltd., CRYPTRON COSMO SERIES manufactured by Kawasaki Heavy Industries. Ltd. and INOMIZER SYSTEM manufactured by Hosokawa Micron Co.; those employing a dry mechanical method, such as MECHANO FUSION SYSTEM manufactured by Hosokawa Micron Corp., and MECHANO mill manufactured by Okada Seiko Co., Ltd.; and those employing a wet coating method, such as DISPER COAT manufactured by Nissin Engineering Inc., and COAT MIZER manufactured by Freunt Sangyo Co. Two or more of these apparatuses may be used in an appropriate combination.

The toner produced in the aforementioned manner preferably has a volume average particle diameter (D50v) in the range of about 3 to about 10 μm, and more preferably in the range of about 4 to about 8 μm. The toner preferably has a ratio (D50v/D50p) of the volume average particle diameter (D50v) to the number average particle diameter (D50p) in the range of about 1.0 to about 1.25. Such a toner having a small particle diameter and a narrow diameter distribution has improved evenness in chargeability, and provides an image with a reduced level of fogging and improved reproducibility of fine lines and dots, and has improved fixability.

The circularity of the toner is preferably about 0.9 or more, and more preferably about 0.960 or more. Moreover, the standard deviation of circularity is preferably about 0.040 or less, and more preferably about 0.038 or less. These ranges allow the toner to be densely stacked on a recording medium. Therefore, the thickness of the resultant toner layer can be thin and improved fixability of the toner can be obtained. In addition, making the toner shape uniform allows fogging and reproducibility of fine lines and dots in the resultant image to improve.

The average circularity of the toner can be obtained by measuring the circumferential length of the projected image of each of a predetermined number of toner particles (circumferential length), and that of a circle having the same area as the projected area of the corresponding toner particle (circumferential length of the corresponding circle) in an aqueous dispersion system with a flow-type particle image analyzer (FPIA 2000 manufactured by Sysmex Corp.), calculating the ratio of the circumferential length of the corresponding circle to the circumferential length, and averaging the calculated ratios.

On the other hand, toner particles produced by a wet granulation method preferably have an average shape factor (SF1) in the range of about 110 to about 135.

The average shape factor (SF1) of the toner is obtained by capturing the optically microscopic images of 50 or more of toner particles scattered on a slide glass into a Luzex image processor through a video camera, obtaining the maximum length and the projected area of each of the toner particles, calculating the shape factor of each of the toner particles in accordance with the following equation (2), and averaging the calculated shape factors.

$$SF1=(ML^2/A)\times(\pi/4)\times 100 \qquad \text{Formula (2)}$$

In formula (2), ML denotes the absolute maximum length of a toner particle, and A denotes the projected area of the toner particle.

The volume particle size distribution index (GSDv) of the toner particles is preferably about 1.25 or less.

The volume average particle diameter, and particle size distribution index of the toner of the invention are measured with a device, COULTER COUNTER TAII manufactured by Beckman-Coulter Co., Ltd., and an electrolyte, ISOTON-II manufactured by Beckman-Coulter Co., Ltd.

The number and volume particle size distributions of the toner are also measured with the device. The whole particle size range of each of the number and volume particle size distributions is divided into plural particle size ranges (channels). Cumulative distribution curves are drawn from the smallest particle size range on the basis of the number and volume particle size distributions, respectively. In the cumulative distribution curves, the particle diameters at a cumulant of 16% are defined as a volume particle diameter D16v and a number particle diameter D16p, respectively. Moreover, the particle diameters at a cumulant of 50% are defined as a volume average particle diameter D50v (which corresponds to the aforementioned volume average particle diameter of the toner) and a number average particle diameter D50p, respectively. Similarly, the particle diameters at a cumulant of 84% are defined as a volume particle diameter D84v and a number particle diameter D84p, respectively. The volume average particle size distribution index (GSDv) is the square root of the ratio of D84v to D16v $[(D84v/D16v)^{1/2}]$.

As aforementioned, the inorganic particles and resin particles are the essential components of the toner of the invention.

The inorganic particles are mixed with toner mother particles to improve fluidity of the toner. The content of the inorganic particles is generally in the range of about 0.01 to about 5.0 parts by mass, and preferably about 0.01 to about 2.0 parts by mass relative to 100 parts by mass of the toner mother particles. Examples of the material of the inorganic particles include silica, alumina, titanium oxide, barium titanate, magnesium titanate, calcium titanate, strontium titanate, zinc oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide and silicon nitride. Among these compounds, silica powder has large frictional action on the carrier coating resin.

At least two types of inorganic particles, for example, selected from those particles may be used together. Moreover, the inorganic particles can be used in combination with at least one of metal salts of higher fatty acids, such as zinc stearate, and fluorinated polymer powder serving as a cleaning promoting agent. The inorganic particles can be used in combination with resin powder.

The average particle diameter of the inorganic particles is generally in the range of about 0.01 to about 0.05 μm.

The material of the resin particles can be a known one. The resin particles used in the invention can be obtained, for example, by radical polymerization. The raw material(s) of the resin particles can include at least one styrene monomer. Examples of the styrene monomer include styrene; alkyl styrene such as methylstyrene, dimethylstyrene, trimethylstyrene, ethylstyrene, diethylstyrene, triethylstyrene, propylstyrene, butylstyrene, hexylstyrene, heptylstyrene, and octylstyrene; halogenated styrene such as fluorostyrene, chlorostyrene, bromostyrene, dibromostyrene and iodostyrene; and nitrostyrene, acetylstyrene and methoxystyrene.

The raw material(s) of the resin particles can include at least one acrylic monomer. Examples of the acrylic monomer include alkyl(meth)acrylate such as methyl(meth)acrylate, ethyl(meth)acrylate, butyl(meth)acrylate and lauryl(meth) acrylate; hydroxylalkyl(meth)acrylate such as 2-hydroxymethyl(meth)acrylate and 2-hydroxypropyl(meth)acrylate; monoesters of (meth)acrylic acid and polyhydric alcohols such as trimethylolpropane mono(meth)acrylate and trimethylolethane mono(meth)acrylate; polyalkylenegylcol (meth)acrylate such as polyethyleneglycol mono(meth)acrylate and polypropyleneglycol mono(meth)acrylate; dialkylaminoalkyl(meth)acrylate such as diethylaminoethyl (meth)acrylate; and (meth)acrylamide and glycidyl(meth) acrylate.

At least one of alkylethers of hydroxyalkyl mono(meth) acrylates, polyhydric alcohol mono(meth)acrylates and polyalkyleneglycol mono(meth)acrylates may be used as one of the raw material(s) of the resin particles in the invention. The term "(meth)acrylate" means methacrylate or acrylate.

A predetermined amount of at least one of the radically polymerizable monomers may be emulsion-polymerized in the presence of a polymerization initiator and an emulsifier selected from anionic, nonionic and cationic emulsifiers, or may be soap-free-polymerized in the presence of a water-soluble initiator without using any emulsifier.

The emulsifier is generally used in emulsion polymerization and is well known in the art. Specific examples thereof include sodium higher alcohol sulfonate, sodium alkyldiphenyl ether disulfonate, sodium alkylbenzenesulfonate, sodium dodecylbenzenesulfonate, sodium dialkyl sulfosuccinate, sodium salts of fatty acids, potassium salts of fatty acids, alkyl (or alkylphenyl)ether, sodium sulfate, ammonium sulfate, alkylphenol-ethyleneoxide adduct, higher alcohol-ethyleneoxide adduct, propyleneglycol-ethyleneoxide adduct and quaternary ammonium salts.

The polymerization initiator can be selected from those generally used in emulsion polymerization and soap-free polymerization and may be used according to a conventional method. Specifically, at least one of persulfate polymerization initiators (for example, potassium persulfate and ammonium persulfate) and azobis polymerization initiators (for example, azobisisobutylonitrile) may be used as the polymerization initiator in an appropriate amount.

The amount of the emulsifier is preferably in the range of about 0.0001 to about 0.500 parts by mass relative to 100 parts by mass of the monomer(s).

The polymerization reaction is performed in water serving as a medium according to a conventional method. Spherical resin particles with a volume average particle diameter of about 0.1 to about 0.5 μm may be obtained by adding predetermined amounts of the monomer(s) and polymerization initiator to water, and by polymerizing the monomer(s) in the resultant system, which is being stirred.

After completing the reaction, water used as the medium may be removed by a drier and the resultant resin agglomerates may be disintegrated by a disintegrating device. The drier and the disintegrating device can be selected from those generally used in producing powder. However, it is proper that water is vaporized and removed by spray drying and that the resultant dry matter is then disintegrated with a jet mill.

The resin particles in the invention are made of a non-cross-linking resin, and the non-cross-linking resin is preferably an acrylic resin obtained by polymerizing at least one monomer including at least one acrylic monomer. This is because the molecular weight and particle diameter of the acrylic resin may be readily controlled by adjusting the reaction time of radical polymerization and the kinds of a chain transfer agent and an initiator.

The weight-average molecular weight of the non-cross-linking resin obtained by polymerizing the above component(s) is preferably in the range of about 100,000 to about 1,000,000, and more preferably in the range of about 300,000 to about 600,000.

When the weight-average molecular weight is less than about 100,000, the resin particles are so soft that they may crush due to the stress in a development vessel. The hardness of the resin particles increases, as the molecular weight of the resin of the resin particles increases. When the molecular weight exceeds about 1,000,000, the hardness of the resin, which is not cross-linked, is too high, and, specifically, is similar to those of cross-linked resins. Consequently, such resin particles may not act as a cushion and may abrade the coating resin layer on the surface of each of the carrier cores.

The weight-average molecular weight is measured under the following conditions.

Apparatus: GPC-150C manufactured by Waters Co.

Column: article in which seven columns, KF801 to 807 manufactured by Shodex Co., are connected in a row Temperature: 40° C.

Solvent: tetrahydrofuran (THF)

Flow rate: 1.0 ml/min

Sample: 0.1 ml of sample solution with a concentration of 0.05 to 0.6% by mass

The measuring sample is prepared as follows.

A measuring object is added to THF and the resultant mixture is allowed to stand for several hours. Thereafter, the mixture is sufficiently shaken to well mix the measuring object with THF, until aggregates disappear in the mixture. The mixture is then further allowed to stand for 12 hours or more. Here, the total time for which the mixture is allowed to stand is set at a time not less than 24 hours. The mixture is made to pass through a filter having a pore size of about 0.45 to about 0.5 μm (for example, MYSHORI DISK H-25-5 manufactured by Toso Corp., or EKIKURO DISK 25CR manufactured by German Science Japan, Ltd.) to obtain a GPC sample. The resin concentration of the sample is adjusted at the concentration described above. Thereafter, measurement is conducted under the above conditions. The molecular weight calibration curve of a monodisperse polystyrene standard sample which molecular weight calibration curve is prepared in advance is used in calculating the molecular weight of the sample.

A method for measuring any other resin is the same as the described above.

The volume average particle diameter of the resin particles in the invention is preferably in the range of about 0.1 to about 0.5 μm, and more preferably in the range of about 0.1 to about 0.3 μm. When the volume average particle diameter is smaller than about 0.1 μm, the number of direct contact between the inorganic particles, for example, having an average particle diameter of about 0.01 to about 0.05 μm and the carrier becomes large, which may abrade the coating resin layer of the carrier. When the volume average particle diameter exceeds about 0.5 μm, which is too large, the amount of the resin particles which is necessary to obtain a desired effect becomes large, which may adversely affect fixability and chargeability of the toner and may deteriorate the effect of the resin particles protecting the carrier.

The diameters of the resin particles can be measured with a laser diffraction particle size distribution measuring device (LA-700 manufactured by HORIBA, Ltd.). Specifically, about 0.1 g of the resin particles are taken with a spatula, and two drops of a surfactant is added to the taken resin particles. Forty milliliters of a 0.1% aqueous solution of sodium hexametaphosphorate is further added to the resin particles, and the resultant mixture is stirred with an ultrasonic homogenizer at 150 W for four minutes to prepare an assay sample. The particle size distribution of the assay sample is measured by a batch cell method, and the volume average particle diameter of the assay sample is calculated from the particle size distribution. The measurement is conducted twice, and the measured values are averaged.

The amount of the resin particles is preferably about 0.05 to about 0.5 parts by mass, and more preferably about 0.05 to about 0.2 parts by mass relative to 100 parts by mass of the toner mother particles. When the amount is less than about 0.05 parts by mass, the resin particles cannot serve as spacers. When the amount exceeds about 0.5 parts by mass, the resin particles may adversely affect fixability of the toner.

As for the relation between the amount of the resin particles and that of the inorganic particles, the ratio (A/B) of the mass of the resin particles (A) to that of the inorganic particles (B) is preferably in the range of 1/100 to 100/100, and more preferably in the range of 5/100 to 50/100 so as to obtain the effect of the resin particles serving as spacers protecting the coating resin layer.

The toner in the invention can be obtained by adding the inorganic particles, the resin particles, and optional additives to toner mother particles, followed by thoroughly stirring the resultant mixture with a mixer such as a HENSCHEL mixer.

To sufficiently exhibit the effect of the invention, the inorganic particles are preferably disintegrated so sufficiently as to break agglomerates of the inorganic particles. Although the inorganic particles and the resin particles may be simultaneously added to the toner mother particles, it is preferable to add the resin particles after mixing the inorganic particles with the toner mother particles.

In preparing the electrostatic latent image developer of the invention, the amount of the toner is preferably in the range of about 2 to about 15 parts by mass relative to 100 parts by mass of the carrier.

The electrostatic latent image developer of the invention thus designed and obtained by blending the toner and the carrier can be used in a medium- or high-speed image forming apparatus (linear velocity of about several hundreds mm/second), and may also be used in an image-forming apparatus conducting an ultra-high speed image-forming process with a linear velocity of 1000 mm/second or more. The electrostatic latent image developer is effective in preventing peeling of the carrier coating resin and separation of the electrically conductive material, which are caused by a mechanism that uniquely occurs in such an ultra-high speed image-forming apparatus.

<Image-forming Apparatus>

The image-forming apparatus of the invention needs to form full color images or images for cipher printing from a toner or toners, including color toners, on a recording medium and otherwise it is not particularly limited. Specifically, the apparatus has a unit for forming a toner image on a recording medium and a unit for fixing the toner image on the recording medium.

When the apparatus has an electrophotographic photoreceptor as an electrostatic latent image-holding member, an image can be formed as follows. The surface of the electrophotographic photoreceptor is electrically charged with a Corotron charging unit or a contact charging unit, and is then exposed to light so as to form an electrostatic latent image. Subsequently, the surface of the electrophotographic photoreceptor is brought into contact with or disposed near the surface of a development roller having a developer layer on the surface thereof to allow a toner to adhere to the electrostatic latent image and to thereby form a toner image on the electrophotographic photoreceptor. The toner image formed is transferred to the surface of a recording medium such as paper with another Corotron charging unit. The toner image transferred is fixed on the recording medium with a fixing unit to form an image on the recording medium.

The electrophotographic photoreceptor is usually an inorganic one made of, for example, amorphous silicon or selenium, or an organic one made of a charge generating material and a charge transfer material, such as polysilane or phthalocyanine. The electrophotographic photoreceptor is preferably one made of amorphous silicon for its long life.

The fixing unit needs to fix the toner image by at least one of heating and pressurizing, or illuminating (light), and a heat roll or an optical fixing device (flash fixing device) may be used as such.

The electrostatic latent image developer of the invention can be used in an ultra-high speed image-forming process. The process speed in the image-forming apparatus of the invention is preferably about 1000 mm/second or more, and more preferably about 1500 mm/second or more.

The optical fixing unit used in optical fixing suitable for such a process speed will be described below.

A light source used in the optical fixing can be a conventional one, and examples thereof include a halogen lamp, a mercury lamp, a flash lamp and an IR laser. The light source is preferably a flash lamp, since the flash lamp enables instantaneous fixing and thereby saves energy. The light emission energy of the flash lamp is preferably in the range of about 1.0 to about 7.0 J/cm$^2$, and more preferably in the range of about 2 to about 5 J/cm$^2$.

The light emission energy, per unit area, of the flash light which light emission energy indicates the intensity of a xenon lamp is represented by the following equation (3).

$$S=[(1/2)\times C\times V^2]/(u\times L)\times(n\times f) \quad \text{Equation (3)}$$

In equation (3), n denotes the number of flash lamps which simultaneously emit light, and f denotes lighting frequency (Hz), and V denotes an input voltage (V), and C denotes the capacity of a capacitor (F), and u denotes a process conveying speed (cm/s), and L denotes the effective light emission width of the flash lamps (usually corresponding to the maximum width (cm) of paper), and S denotes an energy density (J/cm$^2$).

The optical fixing method is preferably a delay method in which plural flash lamps are made to emit light with time difference(s). Specifically, in the delay method, plural flash lamps are arranged and are made to sequentially emit light with time difference(s) of about 0.01 to about 100 ms so as to irradiate each portion of a toner image plural times. Since this method enables optical energy to be supplied to the toner image plural times instead of supplying optical energy once through one time emission, the fixing conditions can be mild and both void resistance and fixability can be attained.

When the flash light emitting is conducted plural times with respect to the toner (image), the light emission energy of the flash lamp refers to the total of the light emission energy which each flash lamp gives to a unit area through one emission.

In the invention, the number of the flash lamps is preferably in the range of 1 to 20, and more preferably in the range of 2 to 10. The time difference(s) between light emission of one of the flash lamps and that of the next flash lamp is preferably in the range of about 0.1 to about 20 msec, and more preferably in the range of about 1 to about 3 msec.

The light emission energy which each flash lamp gives through one emission is preferably in the range of about 0.1 to about 1 J/cm$^2$, and more preferably in the range of about 0.4 to about 0.8 J/cm$^2$.

An embodiment of the image-forming apparatus of the invention, which has an optically fixing unit, will be described below with reference to the drawing.

FIG. 1 schematically illustrates the embodiment of the image-forming apparatus. In FIG. 1, a black toner and three color toners of cyan, magenta and yellow toners are used to form toner images.

In FIG. 1, marks 1*a* to 1*d* denote electrically charging units, and marks 2*a* to 2*d* denote exposure units, and marks 3*a* to 3*d* denote photoreceptors (electrostatic latent image-holding members), and marks 4*a* to 4*d* denote development units, and reference numeral 10 denotes recording paper (a recording medium) sent from a roll medium 15 in the direction of the arrow, and reference numeral 20 denotes a cyan color-developing unit, and reference numeral 30 denotes a magenta color-developing unit, and reference numeral 40 denotes a yellow color-developing unit, and reference numeral 50 denotes a black color-developing unit, and marks 70*a* to 70*d* denote transfer rolls (transfer unit), and reference numerals 71 and 72 denote rolls, and reference numeral 80 denotes a transfer voltage supply unit, and reference numeral 90 denotes an optically fixing unit (fixing unit).

The image-forming apparatus shown in FIG. 1 has the developing units (toner image forming units) represented by reference numerals 20, 30, 40 and 50. A unit for forming a full color toner image on a recording medium is composed of these developing units 20, 30, 40 and 50. Each of the developing units has an electrically charging unit, an exposure unit, a photoreceptor and a development unit. The image-forming apparatus also has the rolls 71 and 72 for conveying the recording paper 10 which are disposed on the conveying path of the recording paper 10, and the transfer rolls 70*a*, 70*b*, 70*c* and 70*d*. The transfer rolls 70*a* to 70*d* are so disposed as to face the photoreceptors. Each of the transfer rolls 70*a* to 70*d* presses against the corresponding photoreceptor. The recording paper 10 which has reached the developing unit is sandwiched between the photoreceptor of the developing unit and the corresponding transfer roll, with the surface of the recording paper 10, to which a toner image is not to be transferred, brought into contact with the transfer roll. The image-forming apparatus also has the transfer voltage supply unit 80 for supplying a voltage to each of the four transfer rolls 70*a* to 70*d*, and an optically fixing unit (fixing unit) 90 for irradiating the surface of the recording paper 10 which surface, when the recording paper 10 is passing through the nip portion formed between the photoreceptor and the corresponding transfer roll, is brought into contact with the photoreceptor. The recording paper 10 is conveyed in the direction of the arrow shown in the drawing.

The cyan color-developing unit 20 has a configuration in which the electrically charging unit 1*a*, the exposure unit 2*a*, and the development unit 4*a* are disposed clockwise around the photoreceptor 3*a* in that order. The transfer roll 70*a* is so provided as to come into contact with the portion of the photoreceptor 3*a* disposed between that brought into contact with the development unit 4*a* and that facing the charging unit 1*a*. The other developing units have the same configuration, except that marks are changed. The development unit 4*a* of the cyan color-developing unit 20 in the image-forming apparatus of the invention is charged with a developer containing a cyan toner. Similarly, the development unit of each of the developing units is charged with a developer including a toner for optical fixing having the corresponding color.

The image formation using the image-forming apparatus will be described below. In the black color-developing unit 50, the surface of the photoreceptor 3*d*, which is being rotated clockwise, is uniformly charged with the charging unit 1*d*. The surface of the electrically charged photoreceptor 3*d* is exposed to light with the exposure unit 2*d* to form thereon a latent image corresponding to a black image which is obtained by color separation of an original image to be reproduced. The latent image is developed, or, in other words, a black toner contained in the development unit 4*d* is adhered to the latent image so as to form a black toner image. The same process is conducted in each of the yellow color-developing unit 40, the magenta color-developing unit 30 and the cyan color-developing unit 20, except that the color of the toner is changed. Thus, toner images of respective colors are formed on the surfaces of the photoreceptors of the respective developing units.

The toner images of respective colors formed on the surfaces of the photoreceptors are sequentially transferred to the recording paper 10, which is being conveyed in the direction of the arrow, under the action of the transfer voltages from the transfer rolls 70*a* to 70*d*. The transferred images are laminated on the surface of the recording paper 10 so as to form a full color toner image corresponding to the original image (information). In portions of the full color toner image which are other than black portions, cyan, magenta and yellow toners are laminated in that order, with the cyan toner disposed at the top.

The full color toner image on the recording paper 10 is then conveyed to the optically fixing unit 90, and the optically fixing unit 90 irradiates the toner image with light so as to melt the toner image, whereby the full color toner image is optically fixed on the recording paper.

EXAMPLES

The invention will be described in detail with reference to examples. In the following descriptions, "part(s)" and "%" respectively denote "part(s) by mass" and "% by mass", unless otherwise specified.

<Production of Carrier>

Carrier 1

An amount of a cross-linkable silicone resin (manufactured by Shin-Etsu Chemical Co., Ltd.) having trifluoropropyl groups in a content of 15%, which amount corresponds to 200 parts of the solid matter of the silicone resin, is taken. The silicone resin is dissolved in 1000 cc of toluene serving as a solvent. Electrically conductive carbon black (KETCHEN BLACK EC600JD manufactured by Lion Co., and having a BET specific surface area of 1270 $m^2/g$) is added to the resultant solution so that the mass ratio of the carbon black to the solid matter of the solution is 15%. Two parts of an organic curing catalyst, aluminum di-n-butoxide monoethylacetoacetate, is added to the resultant mixture, and the resultant blend is stirred with a pearl mill to obtain a coating liquid for forming an inner layer.

The coating liquid for forming an inner layer in which the carbon black is dispersed is coated on 100 parts of manganese-strontium ferrite particles (manufactured by Powder Tec Co, and having a volume average particle diameter of 40 μm) serving as cores with a fluidized-bed (spray dry) coating apparatus. Here, the amount of the coating liquid sprayed per unit time is adjusted so that the coating time is one hour. The coated particles are dried at 100° C. Thus, an inner resin layer with a thickness of about 2 μm is formed.

Subsequently, a coating liquid for forming an outermost layer is produced in the same manner as the coating liquid for forming an inner layer, except that the content of the carbon black in the coating liquid is changed to 0.17%. The coating liquid is coated on the inner layer with the fluidized-bed coating apparatus to form an outermost layer. The coated particles are dried at 100° C. and then baked at 270° C. for one hour (thickness of the outermost layer being about 0.3 μm). Thereafter, the resultant is disintegrated and subjected to post treatment with a vibration mill for 30 minutes so as to obtain carrier 1. The mass ratio of the cores to the coating resin layer composed of the inner layer and the outermost layer, and the compositions of the inner layer and the outermost layer are shown in Table 1.

Carrier 2

A separable flask reactor equipped with a stirrer and containing therein water is charged with 100 parts of a methyl methacrylate monomer and 2 parts of an initiator, azoisobutylonitrile. The monomer is suspension-polymerized at 80° C. in the reactor to obtain a methyl methacrylate resin (1) with a weight-average molecular weight of 280,000. A coating liquid for forming an inner layer is produced in the same manner as the coating liquid for forming an inner layer used for preparing carrier (1), except that the cross-linkable silicone resin is replaced with the resin (1).

Subsequently, a separable flask reactor equipped with a stirrer and containing therein 500 parts of water is charged with 90 parts of a methyl methacrylate monomer, 5 parts of glycidyl methacrylate, 5 parts of methacrylic acid, 0.17 parts of electrically conductive carbon black and 3 parts of an initiator, azoisobutylonitrile. The resultant mixture is stirred to obtain a coating liquid for forming an outermost layer containing epoxy-cross-linkable acrylic monomer.

The coating liquid for forming an inner layer is coated on 100 parts of manganese-strontium ferrite particles (manufactured by Powder Tec Co, and having a volume average particle diameter of 40 μm) serving as cores with a fluidized-bed (spray dry) coating apparatus. Here, the amount of the coating liquid sprayed per unit time is adjusted so that the coating time is one hour. The coated particles are dried at 80° C. Thus, an inner resin layer with a thickness of about 3 μm is formed.

Subsequently, the coating liquid for forming an outermost layer is coated on the inner layer with the fluidized-bed coating apparatus to form an outermost layer. The coated particles are dried at 100° C. and the coating resin layer obtained is cured at 200° C. Thereafter, the resultant is disintegrated and subjected to post treatment with a vibration mill for 30 minutes so as to obtain carrier 2(thickness of the outermost layer being about 0.3 μm). The mass ratio of the cores to the coating resin layer, and the compositions of the inner layer and the outermost layer are shown in Table 1.

Carriers 3 to 9

Carrier 3 is produced in the same manner as the carrier 2, except for the following. The coating liquid for forming an inner layer used in preparing the carrier 3 is different from that used in preparing the carrier 2 in that the former does not contain carbon black. Moreover, a coating liquid for forming an outermost layer is prepared in the same manner as the coating liquid for forming an inner layer used in preparing the carrier 3, except that the amounts of the acrylic resin and the carbon black are changed in accordance with Table 1.

Carrier 4 is produced in the same manner as the carrier 1, except for the following. A coating liquid for forming an outermost layer is prepared in the same manner as that used in preparing the carrier 3.

Carrier 5 is produced in the same manner as the carrier 1, except for the following. A coating liquid for forming an outermost layer is prepared in the same manner as that used in preparing the carrier 2.

Carrier 6 is produced in the same manner as the carrier 1, except that an outermost layer is not formed.

Carriers 7 to 9 are produced in the same manner as the carrier 1, except that the content of the cross-linkable silicone resin in the coating liquid for forming an outermost layer is changed in accordance with Table 1. The thicknesses of the outermost layers of the carriers 7 to 9 are 0.1 μm, 1.2 μm and 2 μm, respectively.

The volume average diameter of each of the carriers 1 to 9 is measured and found to be 40 μm.

TABLE 1

| | | Inner layer | | | | Outermost layer | | | | |
|---|---|---|---|---|---|---|---|---|---|---|
| | Core Mass ratio (parts) | Acrylic resin (parts) | Cross-linkable silicone resin (parts) | Carbon (parts) | Curing catalyst (parts) | Acrylic resin (parts) | Cross-linkable silicone resin (parts) | Epoxy-cross-linkable acrylic resin (parts) | Carbon (parts) | Curing catalyst (parts) |
| Carrier 1 | 97.38 | 0 | 2 | 0.30 | 0.02 | 0 | 0.3 | 0 | 0.0005 | 0.001 |
| Carrier 2 | 97.40 | 2 | 0 | 0.30 | 0 | 0 | 0 | 0.3 | 0.0005 | 0 |
| Carrier 3 | 97.70 | 2 | 0 | 0.00 | 0 | 0.3 | 0 | 0 | 0.0005 | 0 |
| Carrier 4 | 97.38 | 0 | 2 | 0.30 | 0.02 | 0.3 | 0 | 0 | 0.0005 | 0 |
| Carrier 5 | 97.38 | 0 | 2 | 0.30 | 0.02 | 0 | 0 | 0.3 | 0.0005 | 0 |
| Carrier 6 | 97.68 | 0 | 2 | 0.30 | 0.02 | 0 | 0 | 0 | 0 | 0 |
| Carrier 7 | 97.58 | 0 | 2 | 0.30 | 0.02 | 0 | 0.1 | 0 | 0.0005 | 0.001 |
| Carrier 8 | 96.68 | 0 | 2 | 0.30 | 0.02 | 0 | 1 | 0 | 0.0005 | 0.001 |
| Carrier 9 | 96.18 | 0 | 2 | 0.30 | 0.02 | 0 | 1.5 | 0 | 0.0005 | 0.001 |

<Production of Resin Particle>

Resin Particle 1

A three-necked flask equipped with a stirrer, a thermometer and a condenser and having a capacity of one liter is charged with 400 parts of water, 100 parts of a methyl methacrylate monomer and 0.5 parts of sodium dodecylbenzenesulfonate serving as an emulsifier. The flask is put into a heating bath to heat the resultant mixture, which is being stirred, at 75° C. Then, 0.5 parts of potassium persulfate serving as an initiator is added to the mixture. The resultant blend, which is being stirred, kept at 75° C. to conduct emulsion polymerization reaction for 8 hours. Thereafter, the flask is taken out of the heating bath and the reaction mixture is cooled down to room temperature. The reaction mixture is dried with a spray dryer, and the resultant product is disintegrated with a jet mill to obtain 95 parts of spherical resin particles with a volume average particle diameter of 0.05 μm.

Resin Particles 2 to 10

Resin particles 2 to 9 are produced in the same manner as the resin particles 1, except that the amount(s) of at least one of the monomer, the emulsifier and the initiator is changed in accordance with Table 2. Resin particles 10 are produced in the same manner as the resin particles 1, except that the amounts of the emulsifier and the initiator are changed and a cross-linking agent is used in accordance with Table 2.

TABLE 2

| Resin particle | Monomer Kind | Monomer Addition amount (parts) | Cross-linking agent Kind | Cross-linking agent Addition amount (parts) | Emulsifier Kind | Emulsifier Addition amount (parts) | Initiator Kind | Initiator Addition amount (parts) | Characteristics of resin particles: Volume average particle diameter (μm) | Characteristics of resin particles: Weight-average molecular weight |
|---|---|---|---|---|---|---|---|---|---|---|
| 1 | Methyl methacrylate | 100 | — | — | Sodium dodecyl-benzene-sulfonate | 0.5 | Potassium persulfate | 0.5 | 0.05 | 450,000 |
| 2 | | 100 | — | — | | 0.35 | | 0.5 | 0.11 | 550,000 |
| 3 | | 100 | — | — | | 0.25 | | 0.5 | 0.20 | 580,000 |
| 4 | | 100 | — | — | | 0.001 | | 0.5 | 0.45 | 500,000 |
| 5 | | 100 | — | — | | 0.0001 | | 0.5 | 0.9 | 460,000 |
| 6 | | 101 | — | — | | 0.25 | | 1.5 | 0.21 | 120,000 |
| 7 | | 102 | — | — | | 0.25 | | 0.1 | 0.23 | 950,000 |
| 8 | | 100 | — | — | | 0.25 | | 2 | 0.20 | 40,000 |
| 9 | | 100 | — | — | | 0.25 | | 0.05 | 0.21 | 1,190,000 |
| 10 | | 100 | Divinyl-benzene | 0.5 | | 0.25 | | 0.5 | 0.22 | *1 |

Note)
*1 The weight-average molecular weight of the resin which has not been cured is 590,000.

<Production of Toner>

A binder resin, an IR absorbent, a pigment, a charge control agent, a wax and a fixing assistant whose amounts are shown in Table 3 are put into a HENSCHEL mixer and are preliminarily mixed. The resultant mixture is melt-kneaded at 135° C. at 250 rpm with an extruder (PMC-30 manufactured by IKEGAI, LTD.). The kneaded product is roughly pulverized with a hammer mill, finely pulverized with a jet mill and classified with an air classifier to obtain toner mother particles with a volume average particle diameter of 6.1 to 6.5 μm.

Hydrophobic silica particles, the resin particles and titanium oxide particles whose amounts are shown in Table 3 are added to 100 parts of the toner mother particles, and the resultant mixture is stirred with a HENSCHEL mixer to obtain toners (YT-1 to YT-17, MT-1, CT-1, KT-1 and ST-1).

TABLE 3

| | | IR absorbent (parts) | Fixing assistant (parts) | Binder resin (parts) | Charge control agent (parts) | Wax (parts) | Pigment: Cyan (parts) | Pigment: Magenta (parts) | Pigment: Yellow (parts) | Pigment: Carbon (parts) | External additive: Silica (parts) | External additive: Resin particle 1 (parts) |
|---|---|---|---|---|---|---|---|---|---|---|---|---|
| Yellow toner | YT-1 | 1 | 0.5 | 92.25 | 1 | 1.5 | 0 | 0 | 2.5 | 0 | 0.9 | 0.15 |
| | YT-2 | 1 | 0.5 | 92.25 | 1 | 1.5 | 0 | 0 | 2.5 | 0 | 0.9 | 0 |
| | YT-3 | 1 | 0.5 | 92.25 | 1 | 1.5 | 0 | 0 | 2.5 | 0 | 0.9 | 0 |
| | YT-4 | 1 | 0.5 | 92.25 | 1 | 1.5 | 0 | 0 | 2.5 | 0 | 0.9 | 0 |
| | YT-5 | 1 | 0.5 | 92.25 | 1 | 1.5 | 0 | 0 | 2.5 | 0 | 0.9 | 0 |
| | YT-6 | 1 | 0.5 | 92.25 | 1 | 1.5 | 0 | 0 | 2.5 | 0 | 0.9 | 0 |
| | YT-7 | 1 | 0.5 | 92.25 | 1 | 1.5 | 0 | 0 | 2.5 | 0 | 0.9 | 0 |
| | YT-8 | 1 | 0.5 | 92.25 | 1 | 1.5 | 0 | 0 | 2.5 | 0 | 0.9 | 0 |
| | YT-9 | 1 | 0.5 | 92.25 | 1 | 1.5 | 0 | 0 | 2.5 | 0 | 0.9 | 0 |
| | YT-10 | 1 | 0.5 | 92.25 | 1 | 1.5 | 0 | 0 | 2.5 | 0 | 0.9 | 0 |
| | YT-11 | 1 | 0.5 | 92.38 | 1 | 1.5 | 0 | 0 | 2.5 | 0 | 0.9 | 0 |
| | YT-12 | 1 | 0.5 | 92.35 | 1 | 1.5 | 0 | 0 | 2.5 | 0 | 0.9 | 0 |
| | YT-13 | 1 | 0.5 | 92.3 | 1 | 1.5 | 0 | 0 | 2.5 | 0 | 0.9 | 0 |
| | YT-14 | 1 | 0.5 | 92.1 | 1 | 1.5 | 0 | 0 | 2.5 | 0 | 0.9 | 0 |
| | YT-15 | 1 | 0.5 | 91.9 | 1 | 1.5 | 0 | 0 | 2.5 | 0 | 0.9 | 0 |
| | YT-16 | 1 | 0.5 | 91.6 | 1 | 1.5 | 0 | 0 | 2.5 | 0 | 0.9 | 0 |
| | YT-17 | 1 | 0.5 | 92.4 | 1 | 1.5 | 0 | 0 | 2.5 | 0 | 0.9 | 0 |
| Magenta toner | MT-1 | 1 | 0.5 | 89.75 | 1 | 1.5 | 0 | 5 | 0 | 0 | 0.9 | 0 |
| Cyan toner | CT-1 | 1 | 0.5 | 92.05 | 1 | 1.5 | 2.7 | 0 | 0 | 0 | 0.9 | 0 |
| Monochromatic toner | KT-1 | 1 | 0.5 | 77.75 | 1 | 1.5 | 0 | 0 | 0 | 17 | 0.9 | 0 |
| Invisible toner | ST-1 | 1 | 0.5 | 94.75 | 1 | 1.5 | 0 | 0 | 0 | 0 | 0.9 | 0 |

TABLE 3-continued

| | | External additive | | | | | | | | | |
|---|---|---|---|---|---|---|---|---|---|---|---|
| | | Resin particle 2 (parts) | Resin particle 3 (parts) | Resin particle 4 (parts) | Resin particle 5 (parts) | Resin particle 6 (parts) | Resin particle 7 (parts) | Resin particle 8 (parts) | Resin particle 9 (parts) | Resin particle 10 (parts) | Titanium oxide (parts) |
| Yellow toner | YT-1 | 0 | 0 | 0 | 0 | 0 | 0 | 0 | 0 | 0 | 0.2 |
| | YT-2 | 0.15 | 0 | 0 | 0 | 0 | 0 | 0 | 0 | 0 | 0.2 |
| | YT-3 | 0 | 0.15 | 0 | 0 | 0 | 0 | 0 | 0 | 0 | 0.2 |
| | YT-4 | 0 | 0 | 0.15 | 0 | 0 | 0 | 0 | 0 | 0 | 0.2 |
| | YT-5 | 0 | 0 | 0 | 0.15 | 0 | 0 | 0 | 0 | 0 | 0.2 |
| | YT-6 | 0 | 0 | 0 | 0 | 0.15 | 0 | 0 | 0 | 0 | 0.2 |
| | YT-7 | 0 | 0 | 0 | 0 | 0 | 0.15 | 0 | 0 | 0 | 0.2 |
| | YT-8 | 0 | 0 | 0 | 0 | 0 | 0 | 0.15 | 0 | 0 | 0.2 |
| | YT-9 | 0 | 0 | 0 | 0 | 0 | 0 | 0 | 0.15 | 0 | 0.2 |
| | YT-10 | 0 | 0 | 0 | 0 | 0 | 0 | 0 | 0 | 0.15 | 0.2 |
| | YT-11 | 0 | 0.02 | 0 | 0 | 0 | 0 | 0 | 0 | 0 | 0.2 |
| | YT-12 | 0 | 0.05 | 0 | 0 | 0 | 0 | 0 | 0 | 0 | 0.2 |
| | YT-13 | 0 | 0.1 | 0 | 0 | 0 | 0 | 0 | 0 | 0 | 0.2 |
| | YT-14 | 0 | 0.3 | 0 | 0 | 0 | 0 | 0 | 0 | 0 | 0.2 |
| | YT-15 | 0 | 0.5 | 0 | 0 | 0 | 0 | 0 | 0 | 0 | 0.2 |
| | YT-16 | 0 | 0.8 | 0 | 0 | 0 | 0 | 0 | 0 | 0 | 0.2 |
| | YT-17 | 0 | 0 | 0 | 0 | 0 | 0 | 0 | 0 | 0 | 0.2 |
| Magenta toner | MT-1 | 0 | 0.15 | 0 | 0 | 0 | 0 | 0 | 0 | 0 | 0.2 |
| Cyan toner | CT-1 | 0 | 0.15 | 0 | 0 | 0 | 0 | 0 | 0 | 0 | 0.2 |
| Monochromatic toner | KT-1 | 0 | 0.15 | 0 | 0 | 0 | 0 | 0 | 0 | 0 | 0.2 |
| Invisible toner | ST-1 | 0 | 0.15 | 0 | 0 | 0 | 0 | 0 | 0 | 0 | 0.2 |

Note)
Magenta pigment: Pigment Violet 19 (HOSTAPERM RED E2B70 manufactured by Clariant Co.)
Cyan pigment: Pigment Blue15:3 (BLUE No. 4 manufactured by Dainichi Color and Chemicals Mgf. Co.)
Yellow pigment: Pigment Yellow 185 (HARIOTOL D1155 manufactured by BASF)
Carbon black: NIPEX 35 manufactured by Degussa Co.
IR absorbent: a mixture of diimonium (NIR-IM1 manufactured by Nagase Chemtex Corp.) and cyanine pigment (CTP-1 manufactured by Fuji Photo Film Co., Ltd.) at a mass ratio of 1:1
Fixing assistant: ester wax (WEP-5F manufactured by Nippon Oils and Fats Co.)
Binder resin: cross-linkable polyester resin (FP126 manufactured by Kao Co., and having an acid value of 10 mgKOH/g and a softening temperature of 103° C.)
Charge control agent: quaternary ammonium salt (TP415 manufactured by Hodogaya Chemical Co., Ltd.)
Wax: polyethylene (CERIDUST 2051 manufactured by Clariant Co.)
External additive silica: TG820F manufactured by Cabot Co.
Titanium oxide: NKT90 manufactured by Nippon Aerosil Co., Ltd.

<Production of Developer>

Six parts of each of the yellow toners YT-1 to YT-17 is added to 94 parts of the carrier 1. Moreover, six parts of the yellow toner YT-3 is added to 94 parts of each of the carriers 2 to 9. Each of the resultant mixtures is stirred with a ball mill having a capacity of 10 liters for two hours to produce 25 kinds of two-component yellow developers, the amount of each of which is seven kilograms.

Two-component developers are produced in the same manner as the yellow developer including the yellow toner YT-1, except that the yellow toner YT-1 is replaced with each of the magenta toner (MT-1), the cyan toner (CT-1), the monochromatic toner (KT-1), and the invisible toner (ST-1).

Examples 1 to 20 and Comparative Examples 1 to 5

After an endurance test (continuous printing) is conducted, the characteristics of at least one predetermined image formed from each of the two-component yellow developers are evaluated. The types of the carrier and the yellow toner contained in the developer used in each example are shown in Table 4. The apparatus used in the evaluation is obtained by remodeling a printer, DOCUPRINT 1100CF manufactured by Fuji Xerox Co., Ltd., and has an optical fixing unit which includes eight xenon flash lamps having a high light emission intensity within the wavelength range of 700 to 1500 nm. When the recording media used are A4-size sheets of paper, the apparatus can output 400 sheets for one minute. Flash light is emitted by a delay light emission method in which each unit area is irradiated with flash light having the same light energy twice. In the delay light emission method, four of the eight flash lamps spaced alternately emit light simultaneously, and, thereafter, the remaining four also emit light simultaneously. Here, the former emit light first toward the surface of paper which surface has a toner image thereon, and the latter then emit light toward the surface. The difference between the light emission time of the former and that of the latter (delay time) is 0.2 msec.

An image having a printing rate of 4% is printed on one million sheets of paper (recording medium) under the above conditions, and lightness (L* value), edge effect and the like are evaluated. Plain paper (NIP-1500LT manufactured by Kobayashi Kirokushi Co. Ltd.) is used as the recording medium.

The evaluation method and the evaluation criteria are described below.

Lightness L* Value

After the image having a printing rate of 4% has been printed on one million sheets of paper, a solid image with a square area having an edge length of 1 inch (2.54 cm×2.54 cm) is printed on one sheet of paper, and the lightness of the printed solid image is measured with an optical densitometer (X-RITE 938 manufactured by X-right Co.), and the resultant L* value is evaluated on the basis of the following criteria.

A: The L* value is 74 or more.

B: The L* value is 72 or more and less than 74.

C: The L* value is less than 72.

Edge Effect

A solid image with a square area having an edge length of 1 inch (2.54 cm×2.54 cm) is printed on one sheet of paper without irradiation of flash light (unfixed), and the image having a printing rate of 4% is then printed on one million sheets of paper, and the solid image is printed again on one sheet of paper without irradiation of flash light (unfixed). The weight of each of the sheets respectively having the first and last printed unfixed images is measured. Thereafter, air is blown over the surfaces of the sheets which surfaces respectively have the first and last printed unfixed images thereon. Then, the weight of each of the sheets is measured again. The amount of the toner adhering to each of the sheets is obtained by subtracting the weight of each of the sheets after the blowing from that of the corresponding sheet before the blowing. The difference between the toner amount of the first printed unfixed image and that of the last printed unfixed image is evaluated on the basis of the following criteria.

A: The difference is less than 0.3 mg/cm$^2$.

B: The difference is 0.3 or more and less than 1.0 mg/cm$^2$.

C: The difference is 1.0 mg/cm$^2$ or more.

Fixing Property

A solid image with a square area having an edge length of 1 inch (2.54 cm×2.54 cm) is printed on one sheet of paper, and the fixing property of the printed solid image is evaluated as follows. The optical density (OD1) of the printed image is measured. An adhesive tape (SCOTCH MENDING TAPE manufactured by Sumitomo 3M Co.) is stuck on the printed solid image and is then peeled off. Thereafter, the optical density (OD2) of the printed solid image is measured again. Here, the measurement of each of the optical densities (STATUS A) is conducted with a spectrophotometer (X-RITE 938 manufactured by X-Rite Co.) and a light source, D50, at 20 (backing white).

Then, the fixing rate of the printed solid image is calculated from the following equation (4) and the measured optical densities.

$$\text{Fixing rate (\%)}=(OD2/OD1)\times 100 \qquad \text{Equation(4)}$$

The fixing property of the printed solid image is evaluated on the basis of the following criteria.

A: The fixing rate is 90% or more.

B: The fixing rate is 80% or more and less than 90%.

C: The fixing rate is less than 80%.

The results are summarized in Table 4.

TABLE 4

| | | | Characteristics after image printing on 1,000,000 sheets | | | | |
|---|---|---|---|---|---|---|---|
| | Carrier No. | Toner | Lightness: L* value | | Edge effect | Fixing rate (%) | |
| Example 1 | 1 | YT-1 | 72 | B | A | 85 | B |
| Example 2 | 1 | YT-2 | 74 | A | A | 90 | A |
| Example 3 | 1 | YT-3 | 77 | A | A | 95 | A |
| Example 4 | 1 | YT-4 | 74 | A | A | 97 | A |
| Example 5 | 1 | YT-5 | 72 | B | A | 98 | A |
| Example 6 | 1 | YT-6 | 77 | A | A | 95 | A |
| Example 7 | 1 | YT-7 | 77 | A | A | 95 | A |
| Example 8 | 1 | YT-8 | 72 | B | A | 96 | A |
| Example 9 | 1 | YT-9 | 73 | B | A | 91 | A |
| Example 10 | 1 | YT-11 | 72 | B | A | 97 | A |
| Example 11 | 1 | YT-12 | 74 | A | A | 95 | A |
| Example 12 | 1 | YT-13 | 77 | A | A | 94 | A |
| Example 13 | 1 | YT-14 | 77 | A | A | 92 | A |
| Example 14 | 1 | YT-15 | 77 | A | A | 90 | A |
| Example 15 | 1 | YT-16 | 77 | A | A | 82 | B |
| Example 16 | 2 | YT-3 | 77 | A | A | 95 | A |
| Example 17 | 5 | YT-3 | 77 | A | A | 95 | A |
| Example 18 | 7 | YT-3 | 72 | B | A | 95 | A |
| Example 19 | 8 | YT-3 | 77 | A | A | 95 | A |
| Example 20 | 9 | YT-3 | 77 | A | B | 95 | A |
| Comparative Example 1 | 1 | YT-10 | 60 | C | A | 89 | B |
| Comparative Example 2 | 1 | YT-17 | 67 | C | A | 97 | A |
| Comparative Example 3 | 3 | YT-3 | 65 | C | A | 95 | A |
| Comparative Example 4 | 4 | YT-3 | 64 | C | A | 95 | A |
| Comparative Example 5 | 6 | YT-3 | 59 | C | A | 95 | A |

Yellow toners need to provide lightness of the solid image, L* value, of 72 or more, no or small change in toner amount (change in toner amount caused by edge effect) and a fixing rate of 80% or more. Table 4 shows that attainment of such necessities requires the carrier of a two-component developer to have an outermost portion (layer) of a cross-linked resin containing carbon black, and the content of carbon black in the outermost portion lower than that in the inner portion (layer), and requires the toner of the two-component developer to have a surface containing inorganic silica particles and non-cross-linking resin particles.

Example 21

A tandem printer shown in FIG. 1, and having four developing units in a row, an ability of outputting 400 A4-size sheets of paper for one minute and a linear velocity of 2000 mm/sec is provided by remodeling printers, DOCUPRINT 1100CF manufactured by Fuji Xerox Co., Ltd. The developers including the carrier 1 and the respective yellow, magenta, cyan and black toners are put in the four developing units, respectively. The yellow toner used is YT-3. An image is continuously printed on one million sheets of paper and the characteristics of the printed images are evaluated in the above-described manner.

The results show that, even when an image is printed on one million sheets of paper, printed images whose lightness, toner amount and fixing rate hardly change can be obtained.

Example 22

The developer including the invisible toner (ST-1) serving as a toner for cipher printing and the carrier 1 is put in a printer obtained by remodeling a printer, DOCUPRINT 1100CF manufactured by Fuji Xerox Co., Ltd., and having an ability of outputting 400 A4-size sheets of paper for one minute. An image (bar code image) is continuously printed on one million sheets of paper with the printer. The quality of the last printed image is almost the same as that of the first printed image.

Readability of the bar code image printed on the 1,000,000th sheet of paper is judged. The bar cord reader used in the judgment is obtained by remodeling a bar code printer, THLS-6000 & TBR-6000 manufactured by Token Co., and having, as a light source, a laser which emits light having a wavelength of 780 nm, and a detector. In the remodeling, the light source is replaced with an IR light emission diode (GL480Q manufactured by Sharp Co., and having a peak emission wavelength of 950 nm) and the detector is replaced with a photodiode (PD413PI manufactured by Sharp Co., and having a peak sensitivity wavelength of 960 nm).

A reading test is conducted 10 times with the bar code reader, and the bar code image can be read 10 times.

As aforementioned, even when the electrostatic latent image developer of the invention is used in a printer conducting a high-speed image-forming process which outputs at least 400 sheets of paper for one minute, separation of carbon black from the carrier surface can be prevented and high quality images can be stably formed.

What is claimed is:

1. An electrostatic latent image developer comprising a toner and a carrier, wherein:

the carrier comprises cores and a coating resin comprising an electrically conductive material on the surface of each of the cores, the coating resin comprises an inner portion and an outermost portion, the outermost portion comprises a cross-linked resin, and the content of the electrically conductive material in the outermost portion is lower than that in the inner portion, the toner comprises toner mother particles, and, on the surface of each of the toner mother particles, inorganic particles and resin particles, and the resin particles comprise a non-cross-linking resin comprising an acrylic acid or acrylate and having a weight-average molecular weight Mw in a range of 100,000 to 1,000,000.

2. The electrostatic latent image developer of claim 1, wherein the core is made of ferrite comprising any one of manganese, strontium and magnesium.

3. The electrostatic latent image developer of claim 2, wherein the core comprises manganese and, in the form of silicon dioxide, silicon and the content of the silicon dioxide contained in 100 parts by mass of the core is 0.1 to 0.5 parts by mass.

4. The electrostatic latent image developer of claim 1, wherein saturation magnetization of the core is in a range of 45 to 95 $Am^2/kg$.

5. The electrostatic latent image developer of claim 1, wherein the volume average particle diameter of the resin particles are in a range of 0.1 to 0.5 μm.

6. The electrostatic latent image developer of claim 1, wherein the electrically conductive material is carbon black.

7. The electrostatic latent image developer of claim 6, wherein the amount of dibutyl phthalate oil absorption of the electrically conductive material is in a range of 50 to 300 ml/100 g.

8. The electrostatic latent image developer of claim 6, wherein the average particle diameter of the carbon black is 0.1 μm or less.

9. The electrostatic latent image developer of claim 6, wherein the specific surface area of the carbon black is 700 $m^2/g$ or more.

10. The electrostatic latent image developer of claim 1, wherein the content of the electrically conductive material in a portion of the coating resin which portion has a thickness of 0.5 μm from a carrier surface is in a range of 0 to 3% by mass.

11. The electrostatic latent image developer of claim 1, wherein the content of the electrically conductive material in a portion of the coating resin which portion has a depth of more than 0.5 μm from a carrier surface is in a range of 10 to 20% by mass.

12. The electrostatic latent image developer of claim 1, wherein the resistance of the carrier is in a range of $1\times10^4$ to $1\times10^8$ Ω·cm.

13. The electrostatic latent image developer of claim 1, wherein the toner is any one of a cyan toner, a magenta toner and a yellow toner.

14. The electrostatic latent image developer of claim 1, wherein the toner comprises a binder resin having a glass transition point in a range of 50 to 70° C.

15. The electrostatic latent image developer of claim 1, wherein the toner comprises an infrared absorbent.

16. An electrostatic latent image developer comprising a toner and a carrier, wherein:

the carrier comprises cores and a coating resin comprising an electrically conductive material on the surface of each of the cores, the coating resin comprises an inner portion and an outermost portion, and the outermost portion comprises a cross-linked resin, the content of the electrically conductive material in the outermost portion is lower than that in the inner portion, the toner comprises toner mother particles, and, on the surface of each of the toner mother particles, inorganic particles and resin particles, and the resin particles comprise a non-cross-linking resin, and the core is made of ferrite comprising manganese and, in the form of silicon dioxide, silicon and the content of the silicon dioxide contained in 100 parts by mass of the core is 0.1 to 0.5 parts by mass.

17. The electrostatic latent image developer of claim 16, wherein saturation magnetization of the core is in a range of 45 to 95 $Am^2/kg$.

18. The electrostatic latent image developer of claim 16, wherein the volume average particle diameter of the resin particles are in a range of 0.1 to 0.5 μm.

19. The electrostatic latent image developer of claim 16, wherein the electrically conductive material is carbon black.

20. The electrostatic latent image developer of claim 19, wherein the amount of dibutyl phthalate oil absorption of the electrically conductive material is in a range of 50 to 300 ml/100 g.

21. The electrostatic latent image developer of claim 19, wherein the average particle diameter of the carbon black is 0.1 μm or less.

22. The electrostatic latent image developer of claim 19, wherein the specific surface area of the carbon black is 700 $m^2/g$ or more.

23. The electrostatic latent image developer of claim 16, wherein the content of the electrically conductive material in a portion of the coating resin which portion has a thickness of 0.5 μm from a carrier surface is in a range of 0 to 3% by mass.

24. The electrostatic latent image developer of claim 16, wherein the content of the electrically conductive material in a portion of the coating resin which portion has a depth of more than 0.5 μm from a carrier surface is in a range of 10 to 20% by mass.

25. The electrostatic latent image developer of claim 16, wherein the resistance of the carrier is in a range of $1\times10^4$ to $1\times10^8$ Ω·cm.

26. The electrostatic latent image developer of claim 16, wherein the toner is any one of a cyan toner, a magenta toner and a yellow toner.

27. The electrostatic latent image developer of claim 16, wherein the toner comprises a binder resin having a glass transition point in a range of 50 to 70° C.

28. The electrostatic latent image developer of claim 16, wherein the toner comprises an infrared absorbent.

* * * * *